United States Patent [19]

Gautraud et al.

[11] Patent Number: 4,580,780

[45] Date of Patent: Apr. 8, 1986

[54] WOODEN TRUSS FOUNDATION FOR BOWLING LANES

[75] Inventors: Michael Gautraud, Muskegon; William C. Murphy, Fremont; Michael F. Stirling, Spring Lake, all of Ill.

[73] Assignee: Brunswick Corporation, Skokie, Ill.

[21] Appl. No.: 633,213

[22] Filed: Jul. 19, 1984

[51] Int. Cl.[4] ..... A63D 1/00

[52] U.S. Cl. ..... 273/51; 52/691

[58] Field of Search ..... 273/51; 52/690, 691, 52/692, 693, 694

[56] References Cited

U.S. PATENT DOCUMENTS

| | | | |
|---|---|---|---|
| 2,193,468 | 3/1940 | Vickery | 273/51 |
| 3,067,544 | 12/1962 | Willatts | 52/691 X |
| 3,345,792 | 10/1967 | Chandler | 52/691 X |
| 4,320,898 | 3/1982 | Brunst et al. | 273/51 |
| 4,406,456 | 9/1983 | Berry et al. | 273/51 |

*Primary Examiner*—Anton O. Oechsle

*Attorney, Agent, or Firm*—Wood, Dalton, Phillips Mason & Rowe

[57] ABSTRACT

A bowling lane construction adapted for placement on a foundation including an elongated bowling lane and a plurality of supports for the lane, each adapted to be disposed on a foundation for functional engagement with the lower surface of the lane. The supports are generally parallel, spaced along the length of the lane and generally transverse to the direction of elongation thereof. Each such support is formed of a truss having spaced upper and lower chords and at least two vertical braces extending between the chords and at least two elongated tie braces extending diagonally between the chords.

7 Claims, 6 Drawing Figures

WOODEN TRUSS FOUNDATION FOR BOWLING LANES

FIELD OF THE INVENTION

This invention relates to bowling lanes, and more specifically, to a new and improved supporting truss structure for a bowling lane.

BACKGROUND ART

Prior art of possible relevance includes the following U.S. Pat. No. 2,193,468 issued March 12, 1940 to Vickery and U.S. Pat. No. 3,345,792 issued Oct. 10, 1967 to Chandler.

Present day bowling lanes are conventionally built in an elevated position above the foundation of the building or the like in which they are housed. Usually the spacing is on the order of a foot or more.

The two most frequently cited reasons for such a construction are as follows. Firstly, the spacing is required where subway ball returns are used if the building foundation is to have a level floor, which is the most inexpensive to form. Secondly, in some quarters, it has been thought to be undesirable to mount the bowling lane directly on the building foundation, typically concrete, for the reason that it is believed that concrete is too rigid of a substrate to allow the bowling surface to yield under the impact of bowling balls. As a consequence, it is felt that the surface of the bowling lane deteriorates more rapidly because of the lack of yieldability.

In any event, a typical construction today, whether used as a support for natural wood lanes or so-called panelized lanes (sometimes referred to as synthetic lanes) involves the use of wooden components known as sleepers, stringers and levelers.

Sleepers are connected directly to the foundation, typically concrete, and extend generally transversely to the direction of elongation of the bowling lane on four foot centers. Each sleeper will typically be made up of a 2×4 topped by a 1×4 between which shims are located at appropriate intervals.

The stringers are typically 2×10's or 2×12's and extend along the direction of elongation of the bowling lane and are mounted on the sleepers. In a typical lane pair, eight stringers will extend approximately the length of the lane.

The stringers are in turn topped by the levelers and extend transversely to the direction of elongation of the lane at intervals that average approximately 18 inches. Shimming may also be provided between the stringers and the levelers. The components to form the bowling surface are then laid down upon the levelers. Frequently in all types of lanes, and universally in synthetic lanes of the panelized type, transverse members termed "strong backs", such as angle irons, are attached to the underside of the bowling surface components, placed on the stringers, generally to avoid dishing or crowning. This construction provides the requisite elevation for subway ball returns and at the same time, imparts a certain degree of yieldable support to the materials forming the bowling lane to assure a relatively low rate of deterioration of the bowling surface.

However, as the foregoing description implies, the principal components are made of wood. Wood is selected for economic reasons but at the same time provides problems of dimensional stability in the lanes. Specifically, under varying temperature and moisture conditions, the wood undergoes dimensional changes and this is most pronounced in the direction across the grain. As a consequence, the across the grain dimension of 10–12 inches in the stringers provides a considerable length over which across the grain dimensional changes due to temperature and moisture variations can occur with the consequence that the bowling surface supported thereby is not truly vertically dimensionally stable. The ultimate result is that scoring on such lanes may vary from time to time depending upon temperature and moisture conditions within the building housing the lane.

Also of some significance in such construction is the labor required to make the installation. The number of points requiring shimming is quite large—yet shimming is absolutely necessary to obtain a leveling of the bowling surface to a point within specifications of the organizations governing bowling.

The present invention is directed to overcoming one or more of the above problems.

SUMMARY OF THE INVENTION

It is a principal object of the invention to provide a bowling lane construction including an improved support for supporting the lane on a foundation. More specifically, it is an object of the invention to provide such a bowling lane construction wherein vastly improved dimensional stability is obtained and at the same time, construction costs are minimized.

An exemplary embodiment of the invention achieves the foregoing objects in a construction including an elongated structure having an upper surface on which bowling balls are adapted to be rolled at a lower surface. A plurality of supports are provided for the structure, each adapted to be disposed on a foundation for functional engagement with the lower surface of the elongated structure. The supports are generally parallel, spaced along the length of the structure and generally transverse to the direction of elongation thereof. Each of the supports is formed of a truss having spaced upper and lower chords, at least two vertical braces extending between the chords, and at least two elongated tie braces extending diagonally between the chords.

In a preferred embodiment, there are two of such elongated structures in generally parallel relation to form a lane pair and each of the supports is in functional engagement with the lower surfaces of both of the structures.

In a preferred embodiment, four of the tie braces are disposed in alternating fashion between the vertical braces and there is a tie brace associated with each vertical brace on the side thereof remote from the other vertical brace.

Preferably, the chords are generally parallel with the lower chord being shorter than the upper chord and centered between the ends thereof.

Most advantageously, the trusses are formed of wood and the grain of the vertical braces runs vertically and the grain of the tie braces runs in a direction of their extension between the chords to provide greatly improved vertical stability even in a wooden structure.

The invention contemplates the use of conventional lane forming material such as maple and/or pine or panelized bowling lanes of the synthetic variety. In the case of where the latter are being employed, the panels are laid end to end and the supports are located at least at the junctions of the panels.

Other objects and advantages will become apparent from the following specification taken in connection with the accompanying drawings.

DESCRIPTION OF THE PREFERRED EMBODIMENT

Figure 1:
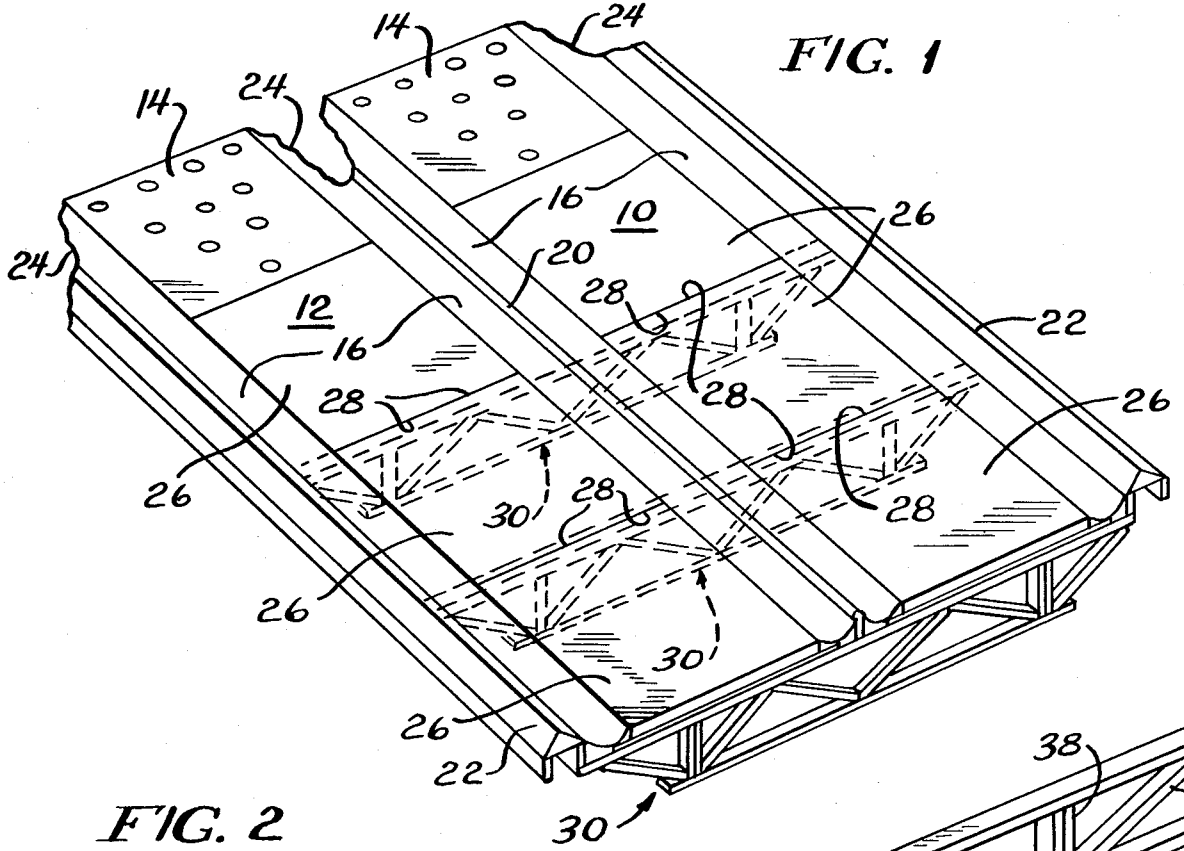
FIG. 1 is a fragmentary perspective view of a bowling lane construction made according to the invention with parts removed for clarity.

An exemplary embodiment of a bowling lane construction made according to the invention is shown in FIG. 1 in the form of a lane pair including right and left lanes 10 and 12 respectively. Each lane is provided with a pin deck 14 and is flanked at both sides by gutters 16 as is well known. A center divider 20 extends between the adjacent gutters 16 in the lane pair while remote gutters 16 flank ball return tunnels 22. Kickbacks (not shown) are typically located in the broken away areas shown at 24.

In the embodiment illustrated in FIG. 1, each lane 10 and 12 is made up of a plurality of panels 26. Ends 28 of the panels 26 are abutted in end to end relation. The panels 26 will conventionally comprise an upper, decorative surface simulating the pine or maple section of the lane as the case may be on any of a variety of substrates commonly employed for the purpose and having sufficient rigidity to prevent substantial deflection of the upper surface as a bowling ball rolled upon the same passes over the decorative layer. The particulars of various sorts of panels useful for the purpose are well known in the art and form no part of the present invention.

At plural intervals along the length of the bowling lane, the same is supported by a truss structure, generally designated 30 which is in a functionally supporting relation to the undersides of the panels 26 of both of the lane 10 and 12. That is, each truss 30 supports corresponding locations of both lanes 10 and 12.

The trusses 30 are elongated and extend generally transverse to the direction of elongation of the lanes 10 and 12, are parallel to each other and, where the bowling surface is formed by panels such as the panels 26, are located at least at the junctions or abutting ends 28 of the panels 26.

In a preferred embodiment, the trusses will be on approximately 36" centers and will have a top to bottom dimension on the order of a foot or more. The trusses thus serve to locate the bowling lanes 10 and 12 sufficiently above the foundation of the building in which they will be typically housed so as to allow the provision of ball return subways under the tunnels 22. They additionally provide a certain degree of yielding support for the lanes 10 and 12 to prevent any possibility of too rapid deterioration due to the impact of balls thereon.

Figure 3:
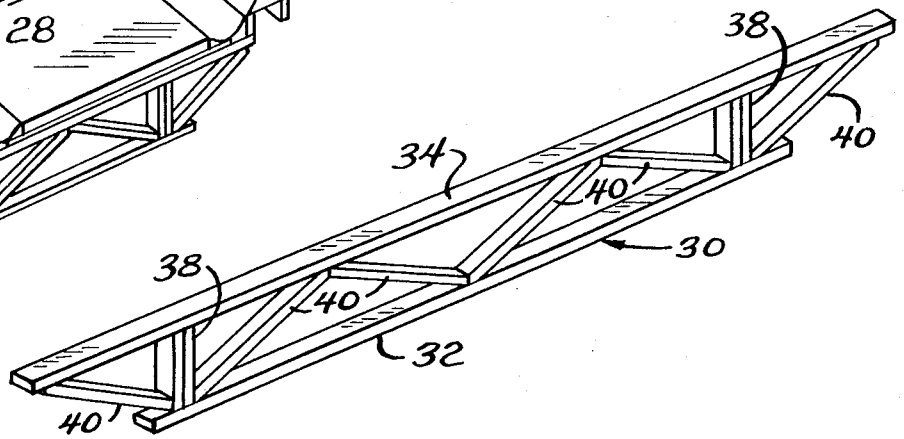
FIG. 3 is a perspective view of a typical truss employed in the construction.
Figure 2:
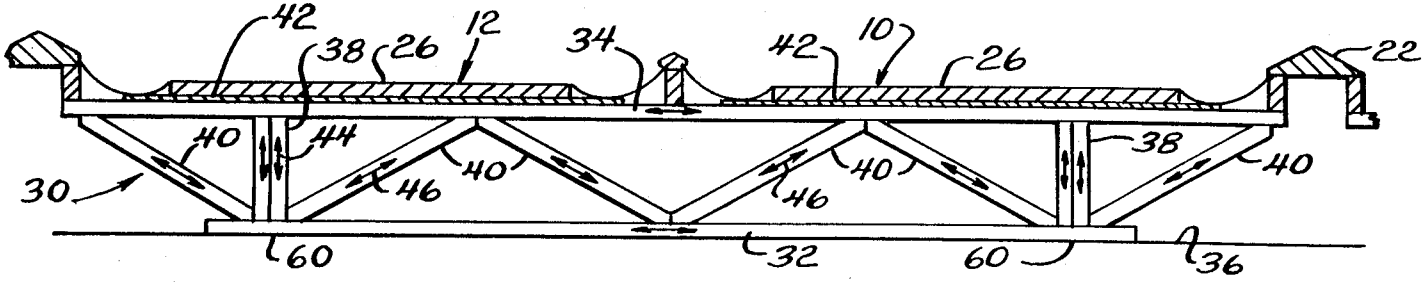
FIG. 2 is a sectional view of the bowling lane taken transversely to its direction of elongation.

Turning now to FIGS. 2 and 3, a preferred form of construction of the trusses 30 will be described. Each includes a lower chord 32 and an upper chord 34 parallel to and spaced above the lower chord 32 sufficiently to provide the desired elevation of the lane above the foundation 36.

Both of the chords 32 and 34 are elongated with the former being shorter than the latter and centered with respect thereto to provide a material savings.

Near opposite ends of the lower chord 32, vertically extending vertical braces 38 extend between the chords 32 and 34. Where the truss 30 is made of wood, the vertical braces 38 may be in the form of two pieces of wood in abutting relation as illustrated.

The truss is completed by tie braces extending between the chords 32 and 34 in a diagonal fashion. Six of the tie braces are shown and designated 40. Four of the tie braces 40 are disposed in alternating fashion between the vertical braces 38 and the remaining two tie braces 40 are disposed on the side of a vertical brace 38 remote from the other vertical brace 38.

Securement of the components together can be accomplished by any suitable means. Where wood is employed, nails, or more preferably, conventional perforated securing plates, may be used at the various junctions of the components.

The upper surface of the upper chord 34 functionally supports the lower surface of the panel 26. This means that there is a supporting relation between the two although direct contact is not required. For example, optionally a thin sheet or strip 42 of fibrous material sold under the trademark Celotex which may be optionally employed for sound deadening purposes.

Where the truss 30 is formed of wood, the components may be made up of 2×4's relatively inexpensively. However, to achieve the improved dimensional stability of the invention, it is important that the grain of the wood used, particularly in the vertical braces, runs vertically as shown by arrows 44. It is also preferably that the grain of the wood used in forming the tie braces 40 have a vertical component, that is, run in the direction of elongation of the tie braces 40 as shown by arrows 46.

While wood as a material for forming the trusses 30 is preferred for economic reasons, other materials may be utilized and the invention contemplates that combinations of different materials may be utilized if desired. The main requirement is that material utilized in forming the vertical ties 38 be dimensionally stable under a wide variation of moisture and temperature conditions.

Figure 4:
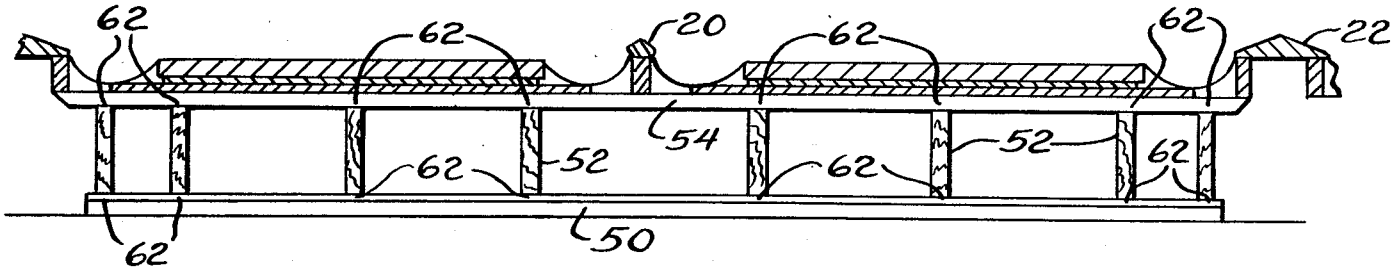
FIG. 4 (PRIOR ART)
FIG. 4 is a view similar to FIG. 2 but illustrating a prior art construction.
Figure 5:
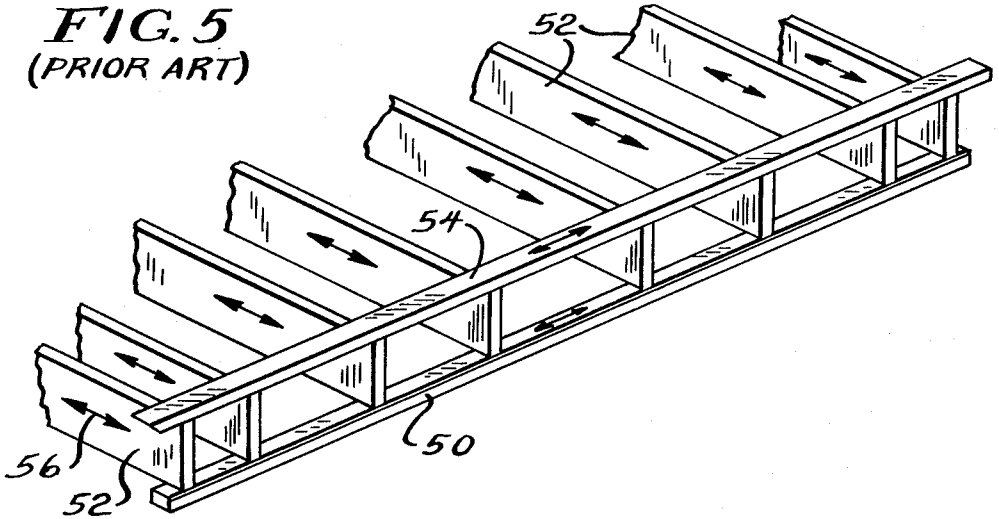
FIG. 5 (PRIOR ART)
FIG. 5 is a view of the sleepers, stringers and levelers typically employed in a prior art construction.

The foregoing construction made according to the invention may be contrasted to prior art practices as illustrated in FIGS. 4 and 5. Therein, the sleepers mentioned previously are designated 50 while the stringers are designated 52. The levelers are shown at 54 and direction of the grain within the stringers is indicated by arrows 56. It will be appreciated that the most dimensionally unstable dimension of the structure is that which extends vertically in the prior art construction. Consequently, such a prior art construction will result in changes in the elevation and the levelness of the bowling surface in response to changes in temperature and humidity.

Furthermore, according to the present invention, shimming of each truss 30 for leveling purposes only need take place at two locations shown at 60 in FIG. 2.

In contrast, in the prior art constructions, shimming is required at each point of abutment of a stringer 52 with a sleeper 50, such that eight such leveling locations may exist. Similarly, eight additional leveling locations may exist in the areas of abutment of the levelers 54 with the stringers 52 for a total of sixteen in contrast to two provided by the present invention. The leveling points in the prior art construction are designated 62.

For each lane (as opposed to lane pair), the present invention eliminates some thirty plus strong backs typically required in prior art constructions. Also eliminated are approximately six splice plates typically employed in prior art panelized lanes. These savings accrue because the trusses of the present invention make the surface components dimensionally stable with respect to each other.

It has been found that a change from 90° F. and 90% relative humidity to 60° F. and 20% relative humidity will produce the following dimensional changes in the prior art structure.

| | | |
|---|---|---|
| Height | .2 inch | |
| Width | .001 per 42 inch width | |
| Length | .008 inch per foot | |
| Level | .0005 inch per inch | .020 Dish and/or Crown (with strongbacks) |
| Flat | .007 inch per inch | .300 Tilt |

Conversely, for the same change, on a worst case basis, the following dimensional changes are encountered in a structure made according to the invention.

| | | |
|---|---|---|
| Height | .05 inch | |
| Width | .001 per 42 inch width | |
| Length | .008 inch per foot | |
| Level | .0005 inch per inch | .020 Dish and/or Crown (without strongbacks) |
| Flat | .001 inch per inch | .040 Tilt |

Figure 6:
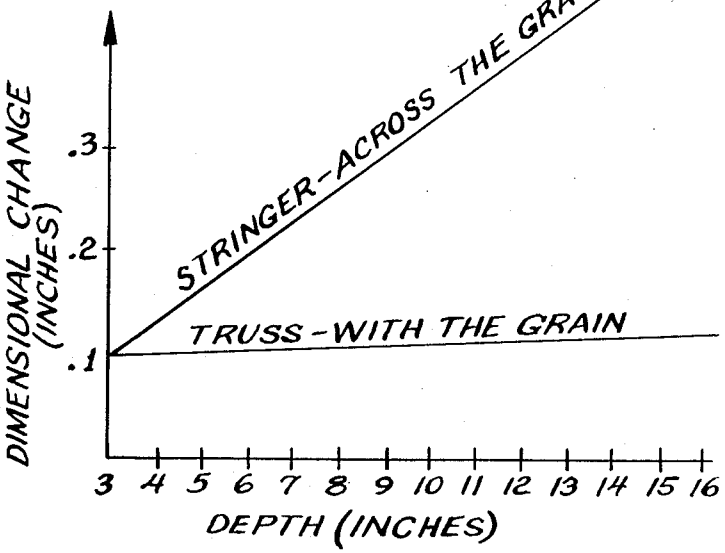
FIG. 6 is a graph illustrating typical dimensional changes of a bowling lane construction made according to the invention and employing wooden trusses as a support versus prior art constructions.

In actuality, the dimensional changes for the structure made according to the invention generally tend to be even less than those specified above as can be readily perceived from an inspection of FIG. 6 which compares dimensional change versus the total height of the foundation (the truss 30 on the one hand versus the stringer 52 on the other) over temperature-humidity conditions from 30° F. and 30% R.H. to 90° F. and 90% R.H.

It has also been found that the present invention provides equal or improved load carrying ability in terms of its ability to support weight or forces placed upon it.

In terms of cost savings, the following table indicates minimum anticipated savings.

| | Factory Material | Field Material | Field Labor | Total |
|---|---|---|---|---|
| Prior Art (% of total cost) | 41 | 11 | 48 | 100 |
| Invention (% of total cost) | 38 | 6 | 38 | 82 |
| Savings (% of Prior Art Item) | 9 | 45 | 20 | 18 |

Principal savings are in labor, the cost of various materials heretofore used to join panels together and to rigidify panels, and the lesser cost of the trusses 30 as compared to the cost of the stringers, levelers, sleepers employed in the prior art construction.

Other advantages are provided in installation in that, at most, the panels need be secured to the supporting structure only at their ends and can be glued to trusses at at least all other locations.

From the foregoing, it will be appreciated that a bowling lane construction made according to the invention provides greatly enhanced dimensional stability over prior art constructions while at the same time providing an appreciable saving in construction costs.

We claim:

1. A bowling lane construction adapted for placement on a foundation comprising:

an elongated structure having an upper surface on which bowling balls are adpated to be rolled and a lower surface; and a plurality of supports for said structure, each adapted to be disposed on a foundation for functional engagement with said lower surface; said supports being generally parallel, spaced along the length of said structure and generally transverse to the direction of elongation thereof, each said support being formed of a wooden truss having spaced upper and lower chords, at least two vertical braces extending between said chords and at least two elongated tie braces extending diagonally between said chords, the grain of said vertical braces running vertically and the grain of said tie braces running in the direction of their extension between said chords.

2. The bowling lane of claim 1 wherein there are two said elongated structures in generally parallel relation, and each of said supports is in functional engagement with the lower surfaces of both said structures.

3. The bowling lane of claim 2 wherein four of said tie braces are disposed in alternating fashion between said vertical braces and there is a tie brace associated with each said vertical brace on the side thereof remote from the other vertical brace.

4. The bowling lane of claim 1 wherein said chords are generally parallel with said lower chord being shorter than said upper chord and centered between the ends thereof.

5. A panelized bowling lane construction adapted for placement on a foundation comprising:

a plurality of panels laid end to end to define an upper bowling surface on which bowling balls are adapted to be rolled and a lower surface; and a plurality of supports for said structure, each adapted to be disposed on a foundation for functional engagement with said lower surface; said supports being generally parallel, spaced along the length of said structure, located at least at the junction of said panels and generally transverse to the direction of elongation thereof; each said support being formed of a wooden truss having spaced upper and lower chords, at least two elongated vertical braces extending between said chords and at least two elongated tie braces extending diagonally between said chords, said braces having their grain running in the direction of their elongation.

6. A bowling lane construction adapted for placement on a foundation comprising:

an elongated structure having an upper surface on which bowling balls are adapted to be rolled and a lower surface; and a plurality of supports for said structure, each adapted to be disposed on a foundation for functional engagement with said lower surface; said supports being generally parallel, spaced along the length of said structure and generally transverse to the direction of elongation thereof; each said support being formed of a truss having spaced upper and lower chords, at least two elongated, wooden vertical braces extending between said chords and at least two elongated, oppositely oriented, wooden tie braces extending diagonally between said chords, said braces having their grain running in the direction of their elongation.

7. A bowling lane construction adapted for placement on a foundation comprising:

an elongated structure having an upper surface on which bowling balls are adapted to be rolled and a lower surface; and a plurality of supports for said structure, each adapted to be disposed on a foundation for functional engagement with said lower surface; said supports being spaced along the length of said structure; each said support being formed of a wooden truss having spaced upper and lower chords and a plurality of elongated vertical and diagonal braces extending between said chords and having their grain running in the direction of their elongation.

* * * * *